US005433007A

United States Patent [19]

Clark et al.

[11] Patent Number: 5,433,007

[45] Date of Patent: Jul. 18, 1995

[54] SELF-CENTERING IMPACT HAND TOOL

[75] Inventors: Emory J. Clark, Spokane; Robert J. Warner, Veradale, both of Wash.

[73] Assignee: Spring Line, Inc., Spokane, Wash.

[21] Appl. No.: 115,892

[22] Filed: Sep. 1, 1993

[51] Int. Cl.[6] ..... B26F 1/00

[52] U.S. Cl. ..... 30/360; 30/367

[58] Field of Search ..... 30/167, 168, 360, 367, 30/359, 366, 358; 81/463; 173/90

[56] References Cited

U.S. PATENT DOCUMENTS

| | | | |
|---|---|---|---|
| 783,749 | 2/1905 | Hartley | 30/367 |
| 833,712 | 6/1906 | Geisenhoner | 30/367 |
| 1,461,032 | 7/1920 | Forsyth | 30/367 |
| 1,887,085 | 11/1932 | Ehrlich | 30/367 |
| 1,931,773 | 10/1933 | Sobol | 30/167 |
| 2,446,848 | 8/1948 | Prester | 30/367 |
| 2,455,577 | 12/1948 | Hager | 30/367 |
| 2,675,079 | 4/1954 | Hughes | 30/367 |
| 3,407,499 | 10/1968 | Rapaport | 30/367 |
| 4,069,586 | 1/1978 | Skelton | 30/360 |
| 5,307,741 | 5/1994 | Clark et al. | 30/367 |

FOREIGN PATENT DOCUMENTS

| | | | |
|---|---|---|---|
| 877157 | 9/1961 | United Kingdom | 30/168 |

OTHER PUBLICATIONS

McMaster-Carr Company Catalog, Chicago, Ill., 1992, p. 1867.

*Primary Examiner*—Hwei Siu Payer

*Attorney, Agent, or Firm*—Wells, St. John, Roberts, Gregory & Matkin

[57] ABSTRACT

A self-centering impact hand tool 10 has a forward tool member 14 with an elongated forward tool body 15 extending from a tool tip 17 to an anvil surface 19 at a rear end 18. The hand impact tool 10 has a plunger member 40 with an elongated forward end 44 having an anvil surface 46 for engaging the anvil surface 19. An elongated coil spring 60 has reduced diameter spring ends 64 and 66 mounted in corresponding spring latching grooves 22 and 54, respectively. Each of the members 14 and 40 have finger gripping sections 21 and 52 that are formed with a series of annular grooves 80 forming finger rings 82 for enabling the user to easily grip and hold the tool member 14 during the operation of the tool and the expansion of the coil spring prior to the release of the plunger member 40. Upon release of the plunger member, the anvil surface 46 of the forward end 44 is driven into a rear section 36 of a driving piston 33 to drive a brad, or nail or center punch rapidly and forcefully into a work surface 12. The number of rings 82 in the finger gripping section 52 is less than the number of rings 82 of in the finger gripping section 21 to minimize premature release of the forward tool member prior to the release of the plunger member 40.

30 Claims, 6 Drawing Sheets

Fig 4
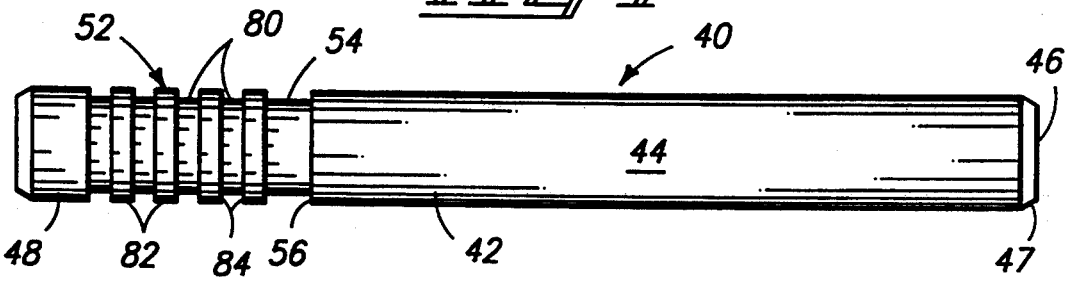
Fig 5
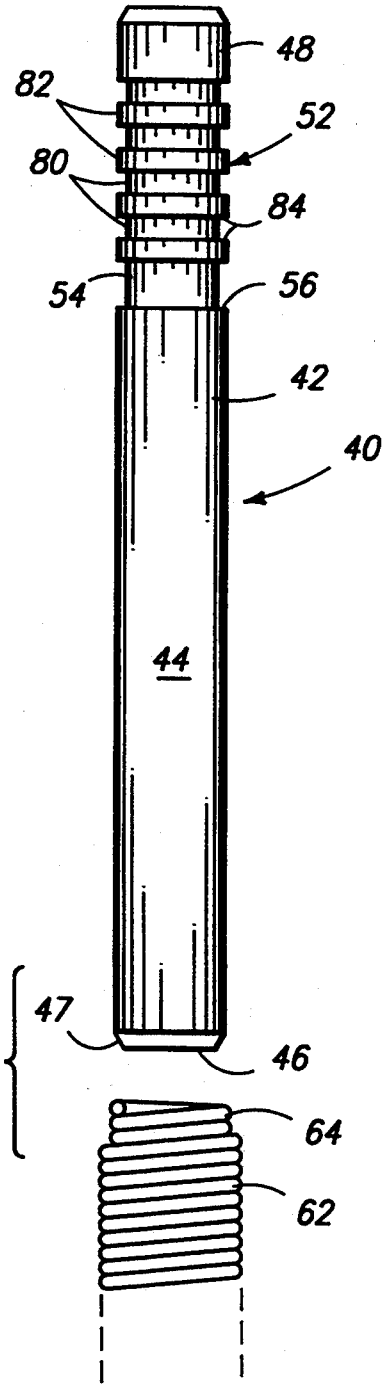
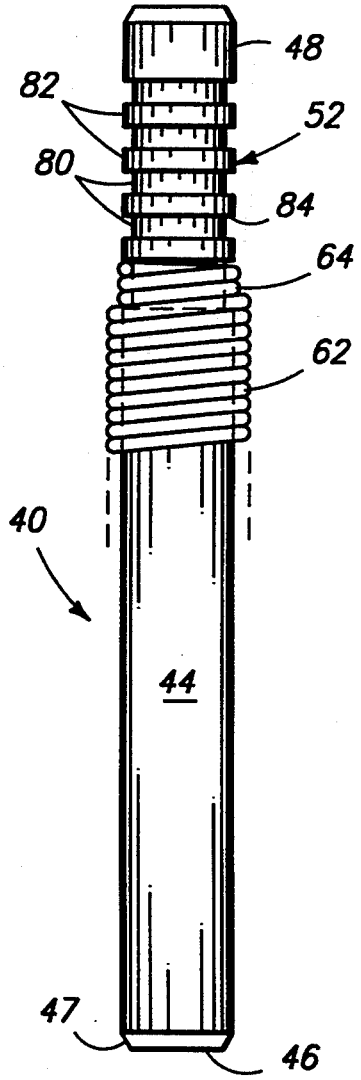
Fig 6

SELF-CENTERING IMPACT HAND TOOL

TECHNICAL FIELD

This invention relates to self-centering impact hand tools.

BACKGROUND OF THE INVENTION

The concept of providing impact hand tools that are spring driven has been suggested for many years. For example U.S. Pat. No. 833,712 granted to H. Geisenhoner on Oct. 16, 1906 shows a prick punch hand tool that is spring driven. However, such hand tool is rather expensive to manufacture and assemble. Numerous other patents show even more complicated and costly hand tools that are likely to wear out prematurely through repeated use, particularly when used in corrosive, dirty or dusty atmospheres.

One of the objectives and advantages of this invention is to provide a spring driven impact hand tool that is safe, inexpensive to manufacture, and unlikely to wear out, even in corrosive, dirty or dusty atmospheres.

These and other advantages of this invention will become apparent upon reading the following detailed description of preferred embodiments.

BRIEF DESCRIPTION OF THE DRAWINGS

Preferred embodiments of the invention are described below with reference to the accompanying drawings, which are briefly described below.

FIG. 4 is an enlarged view of the plunger member of the tool;

FIG. 5 is an enlarged view of the plunger member and one end of the tension driving spring as the one end of the driving spring is being mounted on the plunger member;

FIG. 6 is an enlarged view similar to FIG. 5 except showing the one end of the driving spring fully mounted on the plunger member;

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 2:
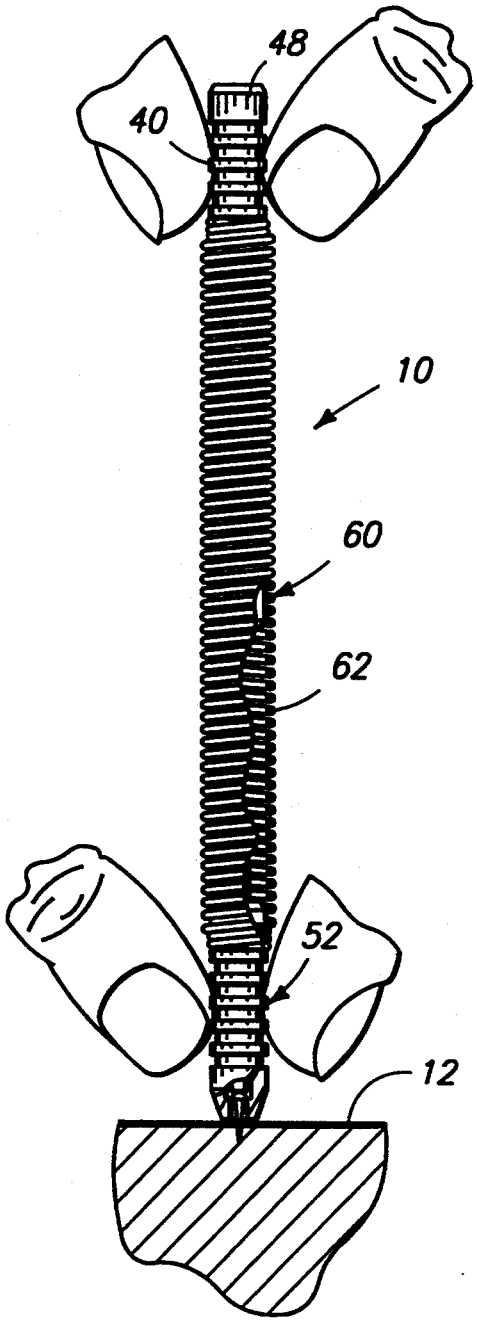
FIG. 2 is a side elevational view similar to FIG. 1 except showing the tool with the driving spring in an expanded condition ready to drive a brad into a work surface.
Figure 3:
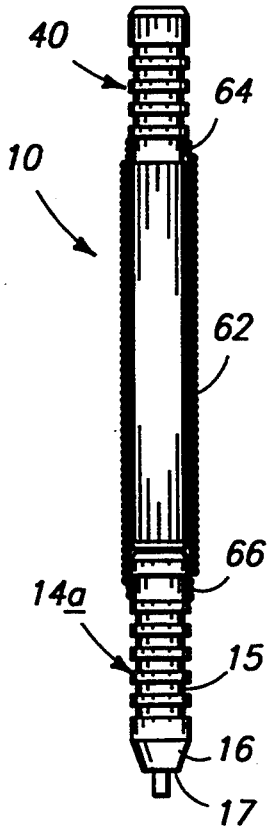
FIG. 3 is a vertical cross sectional view of the tool illustrated in FIG. 1 emphasizing a brad setter member at one end and a plunger member at an opposite end.
Figure 7:
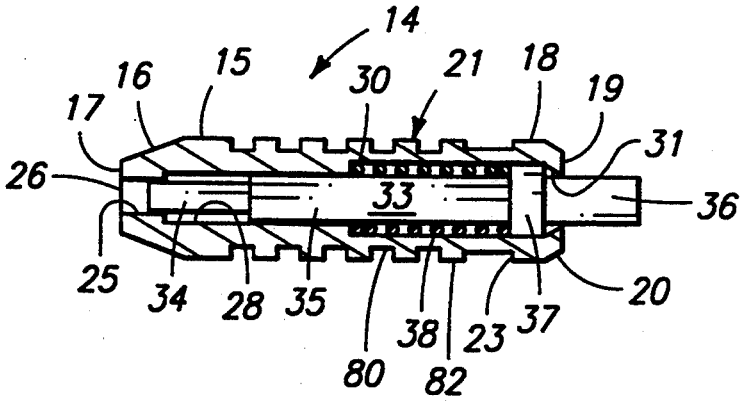
FIG. 7 is an enlarged longitudinal cross sectional view of the brad setter member of the tool.
Figure 13:
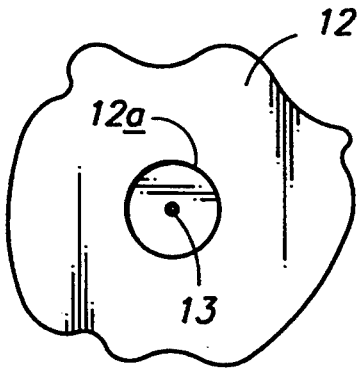
FIG. 13 is a fragmentary pictorial view similar to FIG. 12 except showing a center counter punch indentation made by the tool illustrated in FIG. 10.
Figure 16:
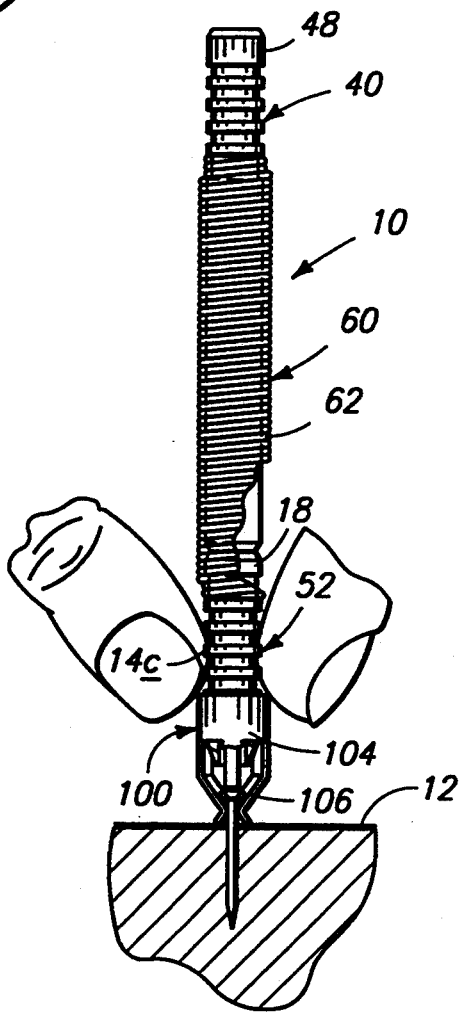
FIG. 16 is a vertical cross sectional view of the tool illustrated in FIG. 15 except showing the nail driven into the work surface.

A preferred and alternate embodiment of the invention is disclosed in the attached drawings showing a self-centering impact hand tool, generally designated with the numeral 10. The tool 10 is designed to drive small nails and brads into wood or similar surfaces 12 as illustrated in FIGS. 2 and 16 or to serve as a center punch to provide a center indentation in a circular recess as illustrated in FIG. 13.

Figure 10:
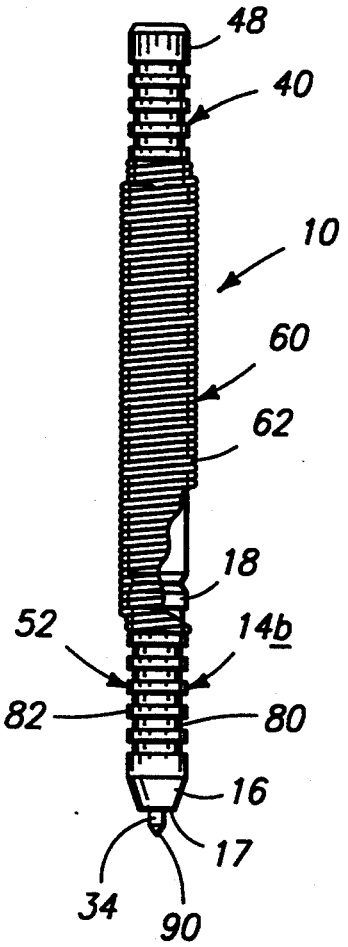
FIG. 10 shows an alternate embodiment of the tool specifically adapted for center punching, in which the tool is shown in an upright orientation with a tension driving spring in a contracted condition.
Figure 11:
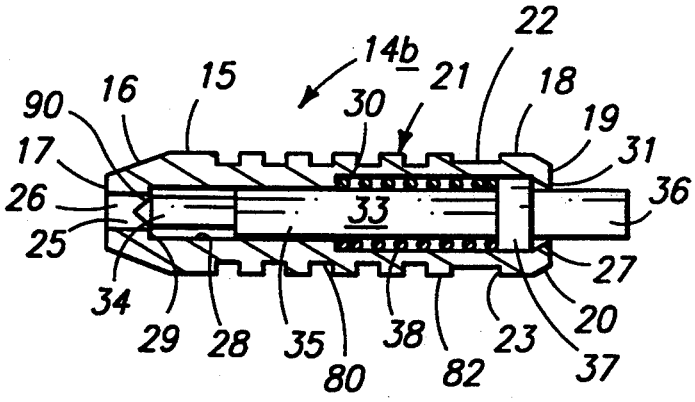
FIG. 11 is an enlarged longitudinal cross sectional view of a center punch member of the tool.
Figure 12:
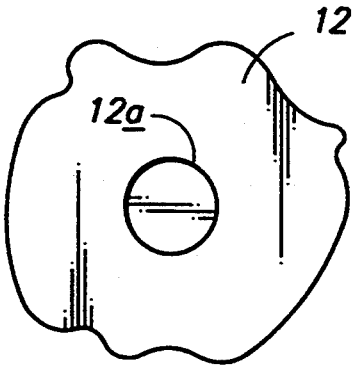
FIG. 12 is a fragmentary pictorial view of a work surface showing a circular indentation prior to application of the center punch.

The impact tool 10 has a forward tool member 14 at one end that is placed adjacent to or engaging the work surface 12. In one embodiment, the forward tool member 14 is the form of a brad setter member **14*a* as illustrated in FIGS. 1–9. In a second embodiment, illustrated in FIGS. 10 and 11, the forward tool member 14 is in the form of a center punch member 14*b*. In a third embodiment, illustrated in FIGS. 14–16, the forward tool member 14 is in the form of a nail setter or shooter member 14*c***.

The brad setter member **14*a* includes a rather elongated cylindrical body 15 having a predetermined maximum diameter. Preferably, the maximum diameter of the tool body 15 is between 0.65 cm. and 0.85 cm. The elongated tool body 15 extends between a front end 16 that has a tool tip 17 and a cylindrical rear end 18 having an annular anvil surface 19. Preferably, the rear end 18 has a diameter that is substantially equal to the maximum diameter of the tool body 15**.

Preferably the rear end 18 has a longitudinal length less than the maximum diameter of the tool body 15. Most preferably the rear end 18 has a longitudinal dimension of between 0.30 cm and 0.50 cm. The anvil surface 18 includes an anvil peripheral bevel 20 to facilitate assembly of the tool 10 and alignment of the impact force, and to minimize anvil deformation along the periphery.

Brad setter member 14a has an exterior finger gripping section 21 that is intermediate the front end 16 and cylindrical rear end 18 to enable the user to firmly grip the brad setter member **14*a* between the thumb and forefinger of one hand to position and hold the tool tip 17 over the brad to be driven below the work surface 12. The section 21** has enhanced gripping interlocking friction characteristics (large coefficient of friction with respect to human fingers) to minimize the unintentional release of the tool member during usage.

The brad setter member 14*a* further includes an exterior spring latching groove 22 that is formed in the tool body 15 intermediate the finger gripping section 21 and the cylindrical rear end 18. The spring latching groove 22 forms a latching shoulder 23 in conjunction with the cylindrical rear end 18.

The tool body 15 has a longitudinal bore 25 extending therethrough forming a front opening 26 in the tool tip 17 and a rear opening 27 in the anvil surface 19. Stepped counter bores 28 form internal forward shoulder 29, internal intermediate shoulder 30 and swaged rear shoulder 31.

The brad setter member 14a includes an elongated anvil piston 33 slidably mounted in the bores 25 and 28. The piston 33 has a reduced forward section or head 34, an intermediate section 35, and a rear or anvil section 36. The intermediate section 35 has an enlarged shoulder ring 37 formed thereon to limit the longitudinal movement of the piston 33 within the, body 16 between the shoulders 30 and 31.

The brad setter member 14*a* further includes a small compression spring 38 mounted in the bores 28 having one end engaging the enlarged shoulder ring 37 and an opposite end engaging the intermediate shoulder 30. This arrangement is designed to bias the piston 33 rearwardly to withdraw the forward section 34 into the bore 25 to receive a brad and project the rear or anvil section 36 outward from the anvil surface 19 as illustrated in FIGS. 2 and 7–9. It should be noted in FIG. 2 that the forward section 34 is sufficiently withdrawn to establish a cavity in the front end of the brad setter member 14*a* for receiving the head portion of a small nail or brad.

The impact hand tool 10 has an elongated plunger member 40 (FIGS. 4–6) at the opposite end from the brad setter member 14*a*. The elongated plunger member 40 has a generally cylindrical elongated plunger body 42 with a maximum diameter corresponding to the maximum diameter of the tool body 15. The plunger body 42 extends between a rather massive forward end 44 having an anvil surface 46 and a tool end 48. The mass of the plunger body 42 is greater than ten times, and preferably greater than fifty times, the mass of the brad setter anvil piston 33. The anvil surface 46 has an anvil peripheral bevel 47 to facilitate the assembly of the impact tool 10 and to facilitate efficient operation of the hand tool 10.

Preferably, the forward end 44 has a diameter corresponding to the maximum diameter of the cylindrical body 42, and most preferably has a diameter between 0.65 cm. and 0.85 cm.

The plunger member 40 has a finger gripping section 52 that is intermediate the forward end 44 and the tool end 48. The finger gripping section 52 preferably has enhanced gripping interlocking friction characteristics (large coefficient of friction with respect to human fingers). Preferably the frictional gripping characteristics of finger gripping section 52, even though large, are less than the frictional characteristics of finger gripping section 21 to minimize the possibility of the premature release of the brad setter member 14*a* prior to the release of the plunger member 40 when the brad setter is ready to drive a brad into the work surface 12.

The plunger member 40 further includes a spring latching groove 54 formed therein between the finger gripping section 52 and the forward end 44 forming a latching shoulder 56 in conjunction with the forward end 44.

The rather massive forward end 44 has a longitudinal length that is at least twice the longitudinal length of the rear end 18 of the brad setter member 14*a*. Preferably, the length of the forward end 44 is more than four times, and most preferably more than eight times, the length of the rear end 18 to enable the plunger member 40 to have a large mass that is at least ten times, and preferably fifty times, that of the brad setter piston 33. Preferably, the length of the forward end 44 is between 3 cm. and 7 cm. Such an arrangement enables the tool 10 to deliver maximum application of force through the brad setter piston 33 to the brad, while still at the same time enabling the user to exercise substantial control of the amount of force applied during any application. Consequently the tool 10 may be used with work surface materials having a wide variance in hardness. Even more importantly, the tool can be used for driving brads into quite brittle material without fracturing or cracking the material, because the application of force is accomplished very rapidly causing deformation of the work material, without fracturing.

Figure 1:
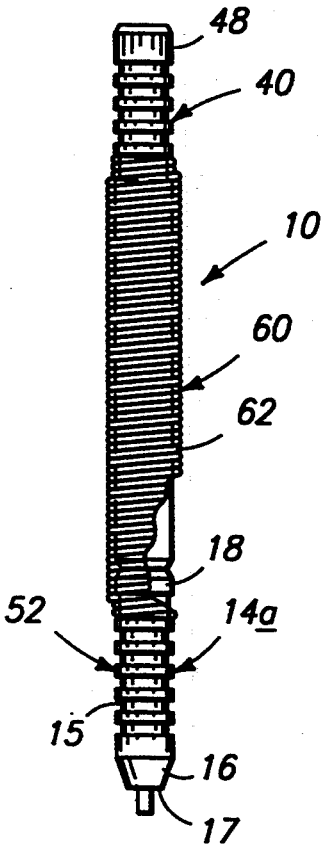
FIG. 1 is a side elevational view of a preferred embodiment of a self-centering impact hand tool specifically adapted for setting brads, in which the tool is shown in an upright orientation with a tension driving spring in a contracted condition.

The hand impact tool 10 includes an elongated tension coil spring 60 that has a rather large constant diameter central section 62 that extends between reduced spring ends 64 and 66. The reduced spring ends 64 and 66 comprise two complete 360 degree coil turns, and preferably between two and five turns. Preferably, the coil spring 60 is made from a high quality spring music wire. Preferably, the coil spring 60 has an initial preload or pre-tension of at least 2 oz. and preferably 1.0 to 1.5 lbs. so that the anvil surfaces 19 and 46 are maintained in engagement when the tool is not in use and to increase axial alignment of the anvil surfaces when in use. The pre-load is sufficient to compress the compression spring 38 and move the brad piston from its retracted position to its extended position as shown in FIG. 1.

The coil spring 60 preferably has sufficient strength to enable the spring to expand between 200 and 500 percent of its original length upon the application of the pulling force on the plunger member 40 that is between 10 and 15 lbs. Preferably, the central section 62 has an inside diameter that is between 0.80 cm. and 0.90 cm. The inside diameter of the central section 62 is greater than the diameter of the forward end 44 so that coils of the spring 60 do not interfere with the movement of the forward end 44. Preferably, the reduced spring ends 64 and 66 have an inside diameter of between 0.50 cm. and 0.85 cm. Most preferably, the reduced spring ends 64, 66 have an inside diameter of approximately 0.66 cm. The spring music wire itself, preferably has a diameter of approximately 0.10 cm.

Preferably, the depth of the spring latching grooves 22 and 54 have a depth that is greater than one-half of the diameter of the spring wire of the coil spring 60. Preferably, the depth of the spring latching groove 22 is between 0.050 cm. and 0.080 cm.

As previously mentioned, the frictional characteristics of the finger gripping section 21 are preferably greater than the finger gripping characteristics of the section 52. Preferably, the finger gripping friction characteristics of section 21 are greater than that of finger gripping section 52 so that a person can easily maintain their grip on the brad setter member 14*a*, and hold the brad setter member in engagement with the work surface 12 before the plunger member 40 is released, as illustrated in FIG. 2.

Each of the finger gripping sections 21 and 52 includes a series of spaced annular grooves 80 formed in the tool body 15 having a depth greater than 0.040 cm. Preferably, the depth of each of the grooves 80 is between 0.040 cm. and 0.080 cm., and more preferably between 0.050 cm. and 0.080 cm. The annular spaced grooves 80 form at least two spaced rings 82. In a preferred embodiment, the grooves 80 form annular sharp edges 84 at the sides of the rings 82 to dramatically increase the gripping friction between the user's fingers and the members 14*a* and 40.

It should be noted that in the preferred embodiment, the finger gripping section 52 has fewer rings 82 than the finger gripping section 21 to minimize premature release of the brad setter member 14*a* prior to the intentional release of the plunger member 40. As illustrated in the drawing, the finger gripping section 52 has four rings 82 as compared to five rings for the section 21.

Each of the annular grooves 80 has a width that is between 1.5 and 2.5 times the depth of the grooves 80. Preferably, the width of the grooves 80 is between 0.120 cm. and 0.200 cm. Each of the rings 82 has a width that is preferably between 1.5 and 2.5 times the depth of the grooves 80. More preferably, the width of the rings 82 is between 0.120 cm. and 0.200 cm. The large frictional characteristics of the finger gripping sections 21 and 52 increase the safety in use of the hand impact tool, and additionally enables the user to quickly learn the proper distance to retract the plunger member or the brad setter member to obtain the desired results.

Figure 8:
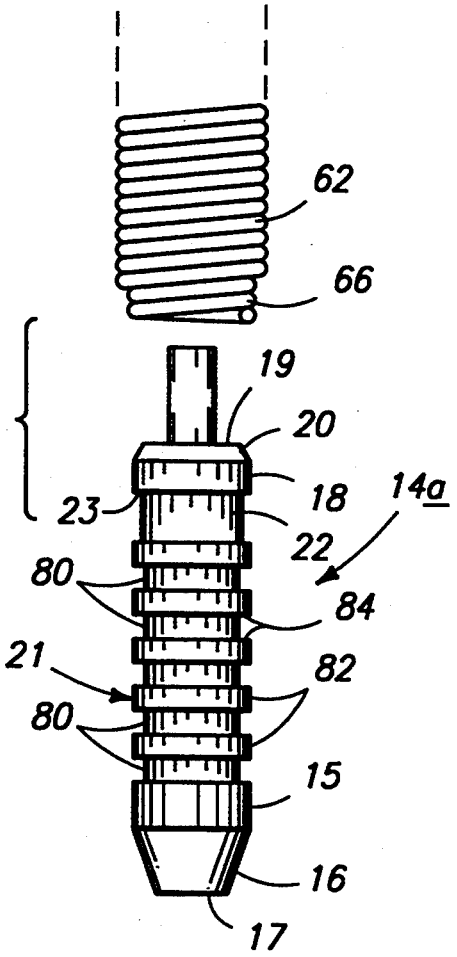
FIG. 8 is an enlarged view of the brad setter member and an opposite end of the tension driving spring as the opposite end of the driving spring is being mounted on the brad setter member.
Figure 9:
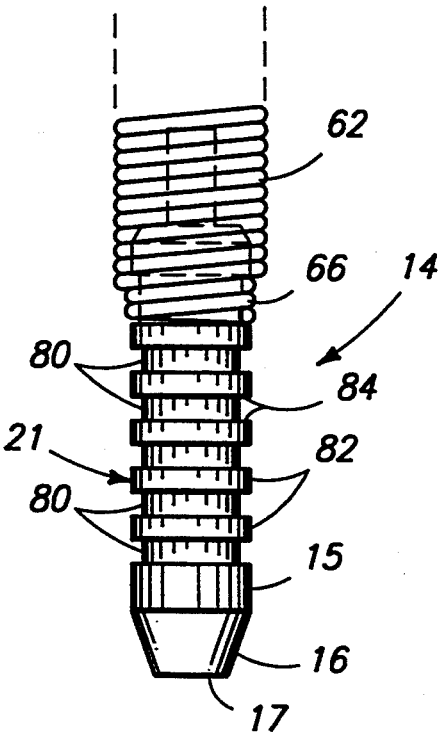
FIG. 9 is an enlarged view similar to FIG. 8 showing the opposite end of the driving sprint; fully mounted on the brad setter member.

One of the advantages of the hand impact tool 10 is its ease of assembly. No special tools are required. As illustrated in FIGS. 5 and 8, the elongated coil spring 60, and particularly the reduced spring end 64, 66 are easily mounted in their respective latching grooves 54 and 22. This is accomplished by merely pushing and rotating the spring end 64 against the beveled anvil surface 46 (FIG. 5). The peripheral bevel 47 causes the reduced spring end 64 to temporarily expand so that the spring end may be slid along the full length of the forward end 44 as illustrated in FIG. 6. The reduced spring end 64 then snaps into the spring latching groove 54 for permanent attachment with one of the coil turns, firmly engaging the latching shoulder 56 for preventing the release of the reduced spring end 64 from the plunger member 40.

Likewise, the reduced spring end 66 is mounted to the tool member 14*a* by merely pushing and rotating the spring end 66 over the anvil rear end 18 until the spring end 66 snaps into the spring latching groove 22. One of the turns of the spring end 66 engages the latching shoulder 23 to prevent release of the spring end from the brad setter member 14*a* during use.

Use of the hand impact tool is illustrated in FIGS. 1–2. Initially, the user grips the hand impact tool with one hand in which a finger and thumb engages and grips the finger gripping section 21 as illustrated in FIG. 1 to position the brad setter member 14*a* over a pre-driven brad. After the correct self-centering position has been obtained, the user, with the thumb and index finger of the other hand grips the finger gripping section 52 of the plunger member 40, and begins to pull the plunger member 40 away from the brad setter member 14*a* as illustrated in FIG. 2 to receive the brad had in the opening. Such movement causes the anvil surfaces 19 and 46 to separate, and increases the tension on the spring 60. As the coil spring 60 expands, it increases the potential energy of the spring which is converted into dynamic energy when the plunger member 40 is released. As the plunger member 40 is moved rearward, the piston retracts. When released, the spring 60 contracts, driving the anvil surface 46 of the forward end 44 into impact engagement with the piston 33 transferring the dynamic energy of the plunger member 40 to the piston 33. In this way, a very rapid and high energy impact force is applied to the piston anvil driving the piston 33 forward against the spring 38 and rapidly driving the brad into the work surface 12 without cracking or fracturing the work surface 12. With only a short amount of practice, a user can easily adjust the stroke of the plunger member 40 to obtain the desire depth of penetration of the brad.

An alternate embodiment, is illustrated in FIGS. 10–13, in which the tool 10 forms a center punch tool with a center punch member 14*b*. The structure is substantially the same as for the brad setter tool illustrated in FIGS. 1–9, except that the forward end 34 of the piston 33 has a pointed conical surface 90. The pointed surface 90 is intended to place an indentation 13 (FIG. 13) in the work surface 12. It is particularly effective in providing a screw starter indentation in a preformed partially drilled hole 12*a* formed in the work surface 12 so that screw is centered in the preformed hole. For example, the forward end of the center punch member 14*b* has a peripheral diameter that is sufficiently small to fit the tool tip 17 into the partially formed hole 12*a*. The plunger member 40 then is pulled rearward retracting the piston 33 and the pointed surface 90. Upon releasing the pointed surface 90 is propelled into the base of the hole 12*a* forming an indentation 13 that is coaxial or centered with respect to the hole 12*a* to enable a user to place a screw or nail centered into the hole 13.

In a third embodiment illustrated in 14–18, the tool 10 is the form of nail setter or shooter with the elongated forward member 14 modified to a nail setter member 14*c*. Such modification included the addition of a nail support 100 on the forward end 16 to receive and support a nail against the tip 17. The nail setter member 14*c* is specially designed for finishing nails having small head that are receivable in the opening 26. However the tool is equally adaptable to receive larger head nails in which the nail head merely seats against the tip 17 rather than being fully received in the opening 26.

Figure 14:
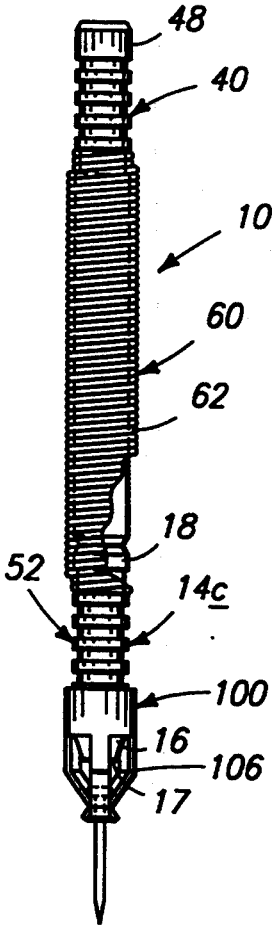
FIG. 14 shows an alternate embodiment of the tool specifically adapted for driving nails into a work surface, in which the tool is shown in an upright orientation with a tension driving spring in a contracted condition.
Figure 17:
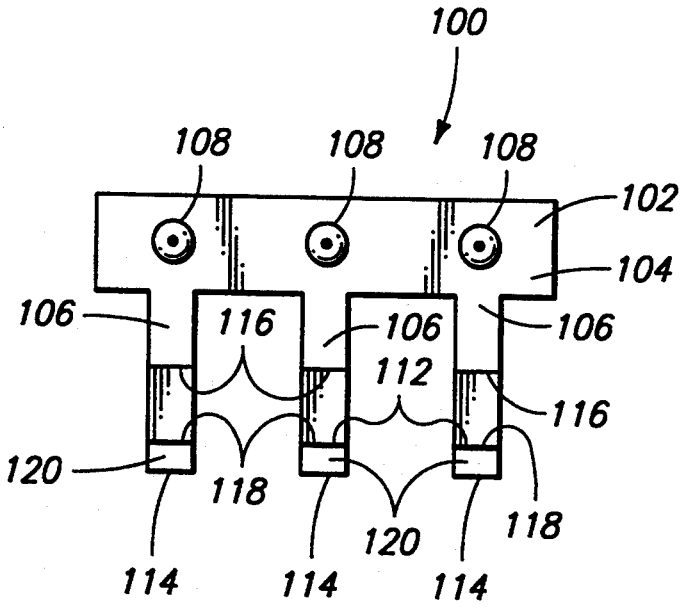
FIG. 17 is an isolated plan view of a nail support for supporting the nails on the tool.
Figure 18:
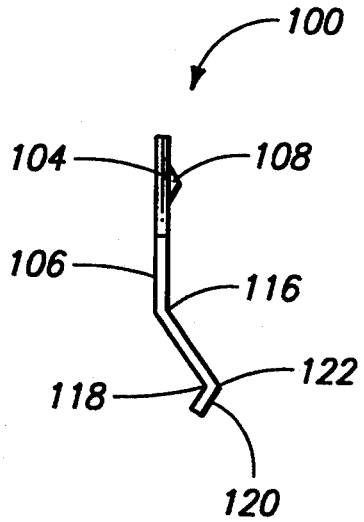
FIG. 18 is an isolated side view of the nail support illustrated in FIG. 17.

Specifically the nail support 100 has a sheet metal body 102 that is shown in flat orientation in FIG. 17 before the body 102 is formed into a cylindrical shape for fitting over the front end 16. The body 102 has a collar section 104 with a plurality of spring gripping fingers 106 (preferably three) that extend therefrom to receive and grip a nail as illustrated in FIGS. 14–16.

The collar section 104 has dimples 108 formed therein that snap into one of the grooves 80 in the finger gripping section 21 when the collar section 104 is slipped over the front end 16 to releasably secure the nail support 100 on the member 14*c*. Each of the fingers 106 extends from a finger base 112 to a finger tip 114. Each finger 106 has a first bend 116 that directs the finger inward to a second bend 118 that extends outward to the tip 114. The bend 116 forms a nail gripping surface 122 for gripping the sides of a nail spaced outward from the nail head. The bend 118 forms a mouth surface 120 for initially receiving the nail head and causing the fingers 106 to spring outward to permit the nail head to be fully inserted to project into the opening 26. The fingers then spring back with gripping surfaces 122 engaging the body of the nail.

Figure 15:
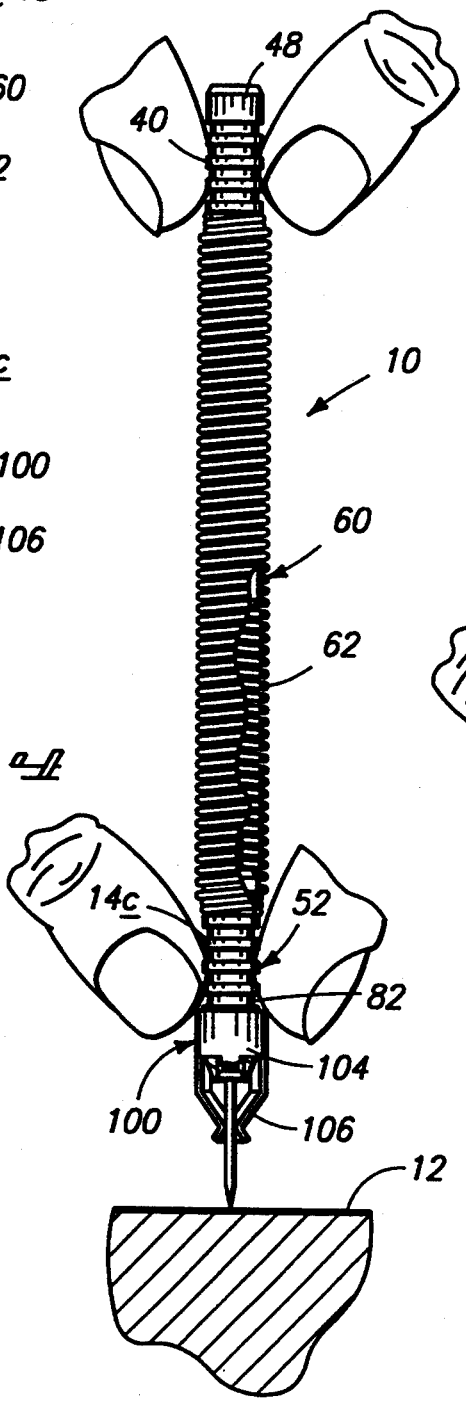
FIG. 15 is a side elevational view similar to FIG. 14 except showing the tool with the driving spring in an expanded condition ready to drive a nail into a work surface.

In the operation of the nail shooter tool, one initially loads a nail in the nail support 100 and then pulls the plunger member 40 rearward to increase the spring tension as illustrated in FIG. 15. Upon releasing the plunger member 40 drives the piston 33 forcibly forward with the forward end 34 engaging and driving the nail into the work surface 12 as illustrated in FIG. 16. It should be noted that the nail support 100 may be adjusted longitudinally on the front end 16 with the dimples 108 moving from one groove 80 to another to accommodate different size nails.

Preferably, the forward tool member 14 and the plunger member 40 are made from the same stock of steel material. The tool member 14 and the plunger member 40 are appropriately heat treated to minimize fracture, fatigue and brittleness, while minimizing deformation of the anvil surfaces 19 and 46 over extended use. Additionally the surfaces of the piston 33 and the bores 25 and 28 have appropriate radius to minimize fracturing.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

We claim:

1. A self-centering impact hand tool, comprising:

an elongated self-centering forward tool member having a elongated forward tool body extending between a forward tool tip at a front end and a first anvil surface at a cylindrical rear end;

said cylindrical rear end having a prescribed diameter;

said elongated forward tool body having a first finger gripping section intermediate the front and rear ends for enabling a user to grip the forward tool member with one hand and place the forward tool tip adjacent a work surface;

said elongated forward tool body having a first annular spring latching groove formed therein intermediate the finger gripping section and the rear end in which the annular spring latching groove has a diameter less than the prescribed diameter of the rear end forming a first latching shoulder;

an elongated plunger member having a plunger body extending between a second anvil surface at a cylindrical forward end and a plunger head end;

said cylindrical forward end having a prescribed diameter;

said plunger body having a second finger gripping section intermediate the forward and head ends for enabling the user to grip the plunger member with a second hand;

said plunger body having a second annular spring latching groove formed therein intermediate the second finger gripping section and the forward end in which the second annular spring latching groove has a diameter less than the prescribed diameter of the forward end forming a second latching shoulder;

said elongated forward member having a longitudinal bore formed therein extending between a front opening at the front end and a rear opening at the rear end;

said forward tool member having a driving piston slidably mounted in the longitudinal bore for movement between a retracted position recessed within the front opening and an extended position extending from the front opening;

said forward tool member having compression spring mounted within the bore for biasing the driving piston from the extended position to the retracted position;

an elongated cylindrical tension coil spring having a central section surrounding the forward end of the plunger member and the rear end of the tool member that extends longitudinally to spring ends that are mounted in respective latching grooves, in which the tension coil spring is expandable from a retracted condition in which the first and second anvil surfaces are held in engagement to an expanded condition in which the user grips both of the finger gripping sections and pulls the members apart to separate the anvil surfaces and increase the tension of the tension coil spring;

said central section of the spring having an inside diameter that is greater than the diameter of the forward end of the plunger member to enable the forward end of the plunger member to move without physical restriction from the central section of the tension coil spring; and each of said tension spring ends having a reduced inside diameter that is less than the diameters of the forward end of the plunger member and the rear end of the forward tool member that fit in respective latching grooves with the reduced diameter spring ends engaging respective latching shoulders to prevent the reduced diameter spring ends from disassociating from the respective spring latching grooves when the coil spring is in the expanded condition and to drive anvil surface of the plunger member sharply against the driving piston to rapidly and forcefully move the driving piston to the extended position when the user releases the retracted plunger member.

2. The self-centering impact hand tool as defined in claim 1 wherein the first and second finger gripping sections have a plurality of spaced annular gripping grooves formed therein defining annular rings therebetween to enable a user to firmly grip the rings and retract the plunger member rearward a substantial distance without the user's finger slipping from the finger gripping sections and prematurely releasing the plunger member.

3. The self-centering impact hand tool as defined in claim 2 wherein the gripping grooves form sharp annular ring edges to minimize unintentional release of the gripping sections.

4. The self-centering impact hand tool as defined in claim 2 wherein each of the finger gripping sections has at least four spaced annular gripping grooves formed therein defining at least three gripping rings for gripping between the user's thumb and index finger.

5. The self-centering impact hand tool as defined in claim 2 wherein at least one of the gripping grooves in each finger gripping section has a groove depth greater than 0.040 cm.

6. The self-centering impact hand tool as defined in claim 2 wherein at least one of the gripping grooves in each finger gripping section has a groove depth between 0.040 cm. and 0.080 cm.

7. The self-centering impact hand tool as defined in claim 2 wherein at least one of the gripping grooves in each finger gripping section has a groove depth between 0.040 cm. and 0.080 cm. and a groove width of between 1.5 and 2.5 times the groove depth.

8. The self-centering impact hand tool as defined in claim 2 wherein each of the gripping grooves in each finger gripping section has a groove depth between 0.050 cm. and 0.080 cm. and a groove width between rings of between 1.5 and 2.5 times the groove depth.

9. The self-centering impact hand tool as defined in claim 2 wherein each of the gripping grooves in each finger gripping section has a groove depth between 0.040 cm. and 0.080 cm. and a groove width of between 1.5 and 2.5 times the groove depth and a ring width between grooves of between 1.5 and 2.5 times the groove depth.

10. The self-centering impact hand tool as defined in claim 2 wherein each of the gripping sections has at least three gripping rings spaced by the gripping grooves, in which each ring has a width of between 0.120 cm. and 0.200 cm.

11. The self-centering impact hand tool as defined in claim 2 wherein the number of gripping grooves in the first gripping section is greater than the number of the gripping grooves in the second gripping section to provide greater gripping friction in the first gripping section than in the second gripping section to minimize unintentional release of the forward tool member prior to release of the plunger member.

12. The self-centering impact hand tool as defined in claim 1 wherein the first gripping section has a greater gripping friction than the second gripping section to minimize unintentional release of the forward tool member prior to release of the plunger member.

13. The self-centering impact hand tool as defined in claim 1 wherein the second anvil surface has a beveled outer perimeter to minimize engagement of the anvil surface with the central section of the coil spring during use of the tool.

14. The self-centering impact hand tool as defined in claim 1 wherein the plunger body has a mass that is greater than ten times that of the driving piston of the forward tool member.

15. The self-centering impact hand tool as defined in claim 1 wherein the plunger member has a mass that is greater than fifty times that of the driving piston of the forward tool member.

16. The self-centering impact hand tool as defined in claim 1 wherein the forward end of the plunger member has a longitudinal length that is greater than eight times a longitudinal length of the rear end of the forward tool1 member.

17. The self-centering impact hand tool as defined in claim 16 wherein each of the Spring latching grooves has a groove width sufficient to receive at least two coil turns of the corresponding spring end.

18. The self-centering impact hand tool as defined in claim 16 wherein each of the spring latching grooves has a depth greater than 0.040 cm.

19. The self-centering impact hand tool as defined in claim 16 wherein the coil spring has a prescribed wire diameter and wherein each of the spring latching shoulders has a depth greater than one-half of the prescribed wire diameter.

20. The self-centering impact hand tool as defined in claim 1 wherein each of the anvil surfaces has a beveled perimeter sufficient to enable the forward end of the plunger member and the rear end of the forward tool member to be inserted into the reduced spring ends during assembly to initially expand the inside diameter of the spring ends and move through the reduced spring ends into the central section enabling the reduced spring ends to snap into the spring latching grooves.

21. The self-centering impact hand tool as defined in claim 1 wherein the coil spring is pre-loaded with a initial tension greater than 1.0 lb. to hold the anvil surfaces in abutment when the coil spring is in the retracted condition.

22. The self-centering impact hand tool as defined in claim 1 wherein the coil spring is pre-loaded with a initial tension greater than the compression force of the compression spring to hold the anvil surfaces in engagement when the coil spring is in the retracted condition and to enable the compression spring to bias the piston to the retracted position when the tension coil spring is expanded.

23. The self-centering impact hand tool as defined in claim 1 wherein the front opening of the elongated tool body is of sufficient size to receive a head of a brad therein when the driving piston is in the retracted position.

24. The self-centering impact hand tool as defined in claim 1 wherein the front opening of the elongated tool body is of sufficient size to receive a head of a nail therein when the driving piston is in the retracted position.

25. The self-centering impact hand tool as defined in claim 24 further comprising a nail support mounted on the front end of the elongated forward tool member for receiving and supporting a nail at the tool tip.

26. The self-centering impact hand tool as defined in claim 25 wherein the nail support is removably mounted on the front end.

27. The self-centering impact hand tool as defined in claim 25 wherein the nail support has a plurality of fingers for engaging a body of the nail forward of the nail head and aligning the nail with the driving piston.

28. The self-centering impact hand tool as defined in claim 25 wherein the nail support is formed of a single piece of sheet material that has been formed into a cylindrical shape and mounted on the front end of the forward tool member.

29. The self-centering impact hand tool as defined in claim 1 wherein the driving piston has a pointed punch end that is recessed within the member front opening when the piston is retracted and extends from the front end when the piston is extended to form a center punch indentation in a work surface.

30. The self-centering impact hand tool as defined in claim 29 wherein the front end of the elongated tool member has a cylindrical peripheral surface and wherein the pointed punch end is coaxial with the peripheral surface.

* * * * *